US006345627B1

(12) United States Patent
Petit

(10) Patent No.: US 6,345,627 B1
(45) Date of Patent: Feb. 12, 2002

(54) COMPACT HAVING SLIDING TRAY THAT OPENS CLASP AND LID

(75) Inventor: Robert Petit, Chevilly-Larue (FR)

(73) Assignee: LIR France, Chevilly-Larue (FR)

( * ) Notice: Subject to any disclaimer, the term of this patent is extended or adjusted under 35 U.S.C. 154(b) by 0 days.

(21) Appl. No.: 09/590,277

(22) Filed: Jun. 9, 2000

(30) Foreign Application Priority Data

Jun. 9, 1999 (FR) ..... 99 07514

(51) Int. Cl.[7] ..... A45D 33/00
(52) U.S. Cl. ..... 132/293; 206/581; 220/263
(58) Field of Search ..... 132/287, 293, 132/294, 295; 206/581; 220/263, 264, 827, 833, 835

(56) References Cited

U.S. PATENT DOCUMENTS 2,054,004 A * 9/1936 Sandberg ..... 132/293
2,633,265 A * 3/1953 Zipper ..... 220/835
3,586,010 A * 6/1971 Landen ..... 132/287
4,595,028 A * 6/1986 Yuhara ..... 132/79
4,774,973 A * 10/1988 Gueret ..... 132/293
5,054,505 A 10/1991 Yuhara
5,344,037 A 9/1994 Favre
5,483,981 A * 1/1996 Vandromme et al. ..... 132/315
5,669,400 A * 9/1997 Sheffler et al. ..... 206/581

FOREIGN PATENT DOCUMENTS

| | | |
|---|---|---|
| EP | 0 570 299 | 11/1993 |
| FR | 2338671 | 8/1977 |
| FR | 2689100 | 10/1993 |

* cited by examiner

*Primary Examiner*—Todd E. Manahan
*Assistant Examiner*—David Comstock
(74) *Attorney, Agent, or Firm*—Connolly Bove Lodge & Hutz LLP

(57) ABSTRACT

A cosmetic case tray is translationally mounted within the case base. Engageable clasp members are respectively mounted to the lid and the tray for releasably securing the lid and base together. A push button is located at a front end of the case and is mounted to the tray for displacing the tray rearwardly within the base upon actuation of the push button in a rearward direction. A horizontally extending member is mounted to a rear end of the tray for horizontally transferring rearwardly exerted force from the push button, to an internal surface of the lid, thereby pushing the lid sufficiently open to hingedly separate the lid and base thereby exposing a cosmetic product.

10 Claims, 3 Drawing Sheets

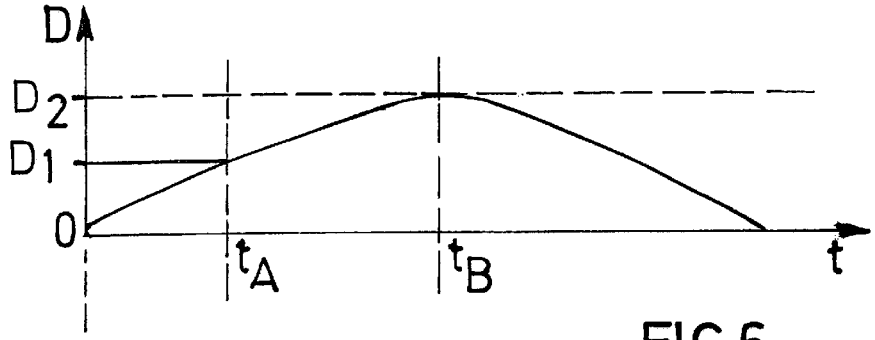
FIG.6
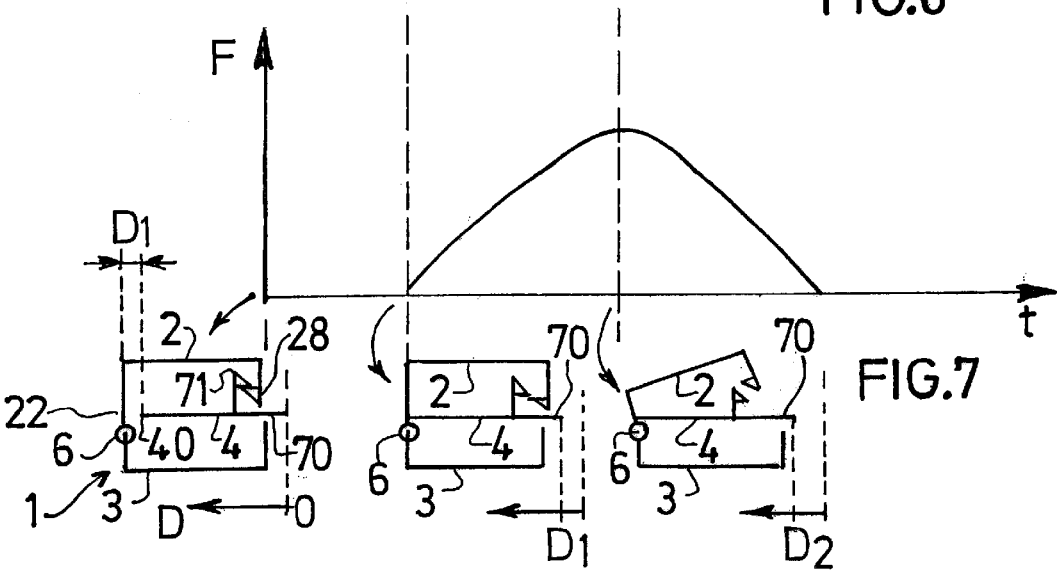
FIG.7
FIG.7a FIG.7b FIG.7c
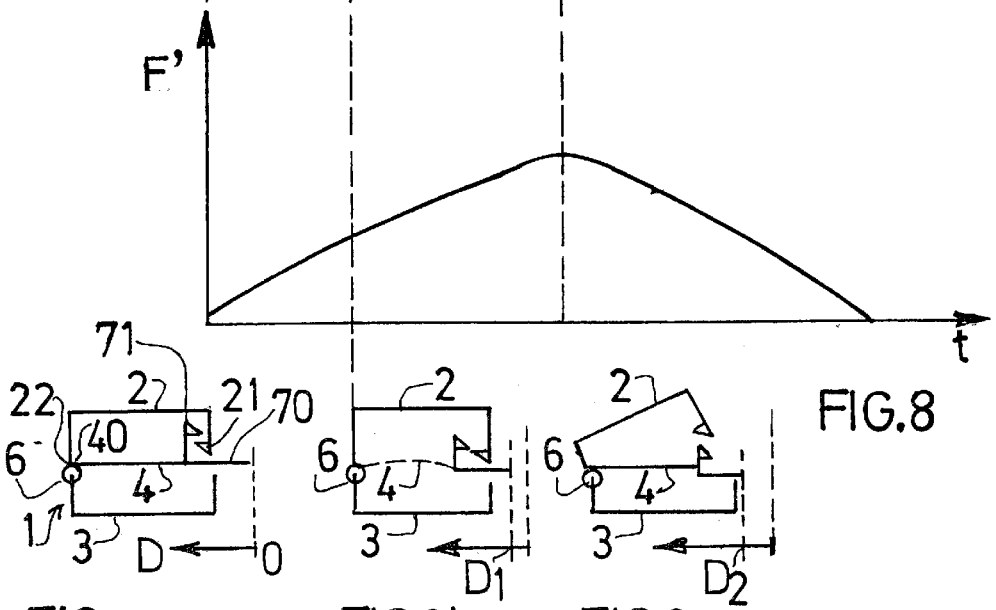
FIG.8
FIG.8a FIG.8b FIG.8c

COMPACT HAVING SLIDING TRAY THAT OPENS CLASP AND LID

FIELD OF THE INVENTION

The invention relates to the field of cases for containing cosmetic or beauty products, typically make-up powders.

PRIOR ART

In general, cases typically comprise:

a hollowed lid fitted with an interior mirror, a hollowed base, typically fitted with a tray or intermediate support for at least one recipient intended to contain said cosmetic product, a hinge, forming the connecting part between said lid and said base, enabling articulation of said lid and the opening of said case, a clasp or any other locking and unlocking means of said lid in relation to said base, such as to ensure the opening and closing of said case, a clasp typically being a pushbutton.

A great number of modalities are known for cases, which modalities may relate to one or more constituents of the case.

In respect of patents made on behalf of the applicant, mention may be made of:

patent FR 2 661 080 which describes a make-up case with a compact clasp, patent FR 2 701 365 which describes a convertible make-up case, patent FR 2 725 958 which relates to a case whose fastening is combined with assisted opening, patent FR 2 737 192 which describes a case with a pivoting lid fitted with a joint having flexible links, patent FR 2 755 352 which describes a case with assisted opening, patent FR 2 755 353 which describes a case with an unlocking and pre-opening pushbutton, patent FR 2 756 155 which describes a make-up case of a type comprising a base, an intermediate tray and a lid fitted with an inner mirror.

PROBLEM RAISED

One of the problems raised by known cases relates to the pre-opening of the case. By pre-opening is meant that when hand pressure is applied to the part of the case intended to ensure its opening, typically a push button which unlocks a catch integral with the lid, the lid opens by also pivoting a certain angle around the case hinge, an angle in the region of 5° to 10°, whose purpose is to facilitate access to the content, typically make-up powder.

With cases of the prior art, to gain substantial pre-opening, typically more than 3 mm, it is required to insert additional means in the hinge of said case, typically a spring built into the hinge which may be in silicon rubber, or in equivalent flexible plastic material having a spring effect, or in added metal, intended to overcome the weight of the lid and the friction forces of the pin or pins of the case hinge. However, this type of device has two disadvantages:

firstly, it constitutes in itself an additional part to be mounted on the case, which increases cost and complicates its assembly, secondly, the action of this type of device is only set in motion after local finger pressure has been lifted, which pressure is usually exerted while holding the case closed between hinge and clasp to prevent operation of the said spring.

The invention sets out to obtain a case which:

firstly, is economical and does not comprise any additional part in relation to a standard case, secondly, enables pre-opening at the same time as the case is caused to be opened, and finally, provides an adjustable degree of pre-opening, in particular a high degree of pre-opening without having to alter the outside appearance of said case.

DESCRIPTION OF THE INVENTION

The case of the present invention, intended to hold cosmetic products, comprises a lid fitted with a first hinge portion, a hollowed base comprising an intermediate tray integral with said base and a dish intended to hold said cosmetic products, said base or said tray being fitted with a second hinge portion, a hinge formed by co-operation between said first and second hinge portions, a clasp or any locking and unlocking means for said lid relative to said base or to said tray, comprising co-operation between a locking catch integral with said lid and a lip integral with said clasp typically provided with a pushbutton and optionally an applicator for said cosmetic product, a case which comprises means for transferring to said lid all or part of the manual pressure applied to said clasp at each opening of said case, such as to ensure pre-opening, even full opening, of the said case, and is characterised in that said means for transferring pressure to said lid is exerted on a supporting edge of the lid adjoining said first hinge portion, typically vertical and positioned just above said hinge, said pressure thereby being transmitted along a typically horizontal direction T similar to the direction formed by said clasp on one side of the case and said hinge on the other side of the case.

These means solve all the problems raised by the state of the art. The applicant has found that it is possible, with a single gesture which is the usual gesture for opening a case, to obtain at least pre-opening of the case whose magnitude is relatively substantial and adjustable and, as will be clearly seen on reading the following figures and detailed description, with no increase in cost.

BRIEF DESCRIPTION OF FIGURES

FIG. 6 is a graph of movement D (along the vertical axis) of pushbutton 70 in relation to time t;

FIGS. 7*a*–7*c,* according to a first embodiment of the invention, shows the resultant pressure F applied against the lid. The figures further illustrating three states at t=0, $t=t_A$, $t=t_B$;

FIGS. 8, 8*a*–8*c* is a second embodiment of the invention which shows the resultant pressure F' applied to the lid, the figures corresponding to FIGS. 7*a*–7*c.

DETAILED DESCRIPTION OF THE INVENTION

Figure 1:
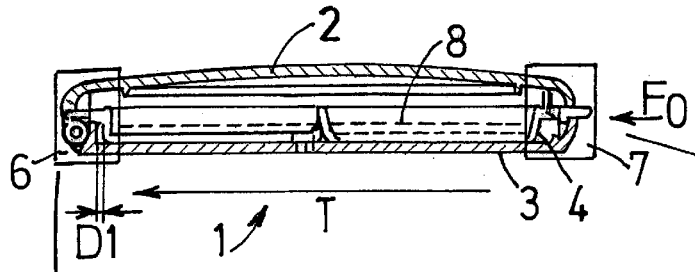
FIG. 1 is a view of case 1 in a vertical section perpendicular to its hinge 6.
Figure 3:
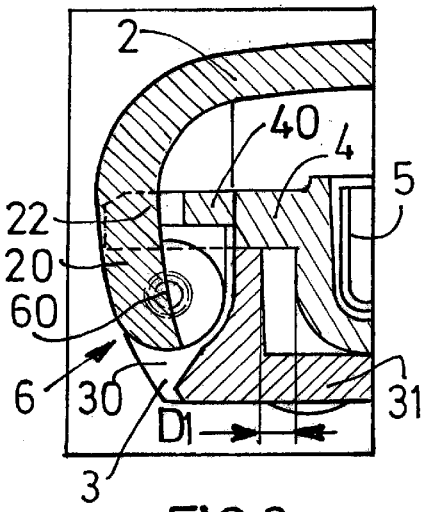

According to the invention, and as shown in FIGS. 1 and 3, means for transferring pressure to a lid is exerted on a supporting edge 22 of lid 2 which adjoins the first hinge portion 20 of the lid, that is typically vertical and positioned just above hinge 6, pressure (denoted Fo in FIG. 1) therefore being transmitted in a typically horizontal direction T close to the direction formed by clasp 7 on one side of the case and hinge 6 on the other side of the case. The hinge rotates about axis 60 and has a lower portion 30.

This part 22 of the lid is typically vertical so that pressure is transmitted as efficiently as possible.

With the case of the invention, the following combination of means may exist:

a) the clasp 7, and typically pushbutton 70, are integral with the tray in direction T such that the manual pressure exerted on the clasp 7, typically on the pushbutton 70, is transmitted to a tray 4 that supports a cosmetic product dish 5.

b) said pressure transfer means comprises said tray 4 which is provided with movement means, typically translation means, in said direction T relative to said base 3, c) said tray comprises an abutting stop 40,41 which comes to press against said supporting edge 22 of lid 2.

Figure 2:
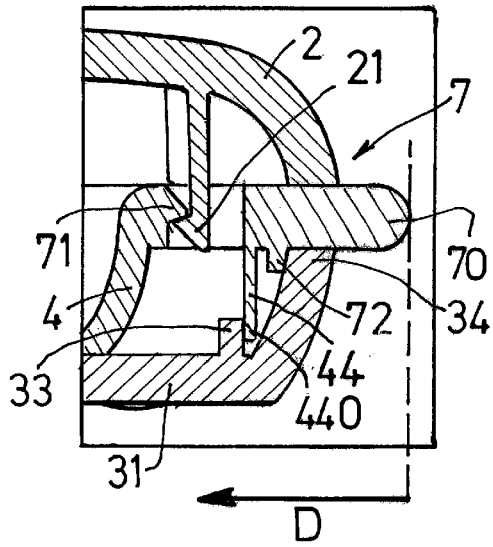
FIGS. 2 and 3 are magnified views of clasp 7 and hinge 6.

This combination of means is shown in FIGS. 1 to 3. These figures illustrate one embodiment of the invention and clearly show the co-operation between the various elements which ensure said transfer, with from right to left: clasp 7 and its pushbutton 70, tray 4 and its abutting stop 40,41, lid 2 and its typically vertical supporting edge 22.

As shown in FIGS. 9*a* to 9*d,* said abutting stop may be formed of a stud 40 and/or a flexible strip having a permanent spring effect 41.

Figure 4:
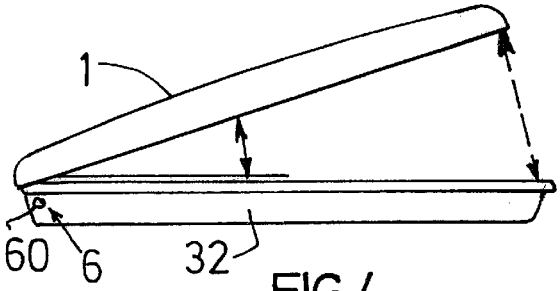
FIG. 4 is a diagram of the pre-opening of case 1 according to the present invention.
Figure 2A:
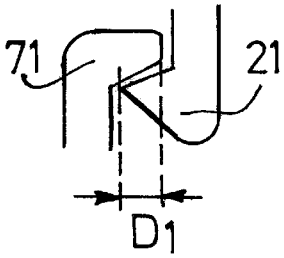

It is evident that these different types of abutting stops and their combination allow pre-opening of varying magnitudes as shown in FIG. 4, and at all events of a pre-determined value, using a standard opening pressure Fo.

It is advantageous according to the invention that said tray 4, said clasp 7 and its pushbutton 70, said abutting stop 40,41 form a single block, all or part of said block typically being rigid. This is the case shown in FIGS. 1 to 4.

According to the invention, said translation means may comprise co-operation between male means 430 and female means 320, either means being carried either by the inner wall of said base 3 or by the outer wall of said tray 4, said co-operation typically forming a runner 8 positioned on the sides or side edges of said base 32 and of said tray 43 and/or on the bottom of said base 31 and said tray 42, said co-operation being formed at the time of assembly of said tray 4 and said base 3 typically by clipping or snap fastening together.

Figure 5:
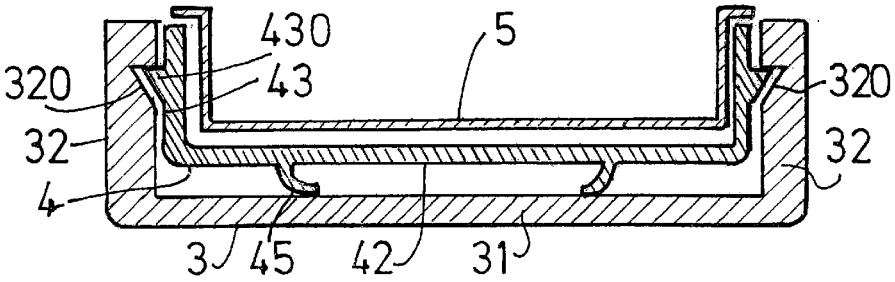
FIG. 5 is a section view, in a plane parallel to axis 60 of the hinge of case 1.

In FIG. 5 is shown the case in which the inner wall of the base, and each of the parallel side edges 32, carry grooves 320 (female means) while the side edges 43 of tray 4 carry ribs 430 (male means), the co-operation between ribs 430 in grooves 320 forming for tray 4 a translation means in relation to said base 3.

Evidently FIG. 5 is only an illustrative example, the tray possibly being provided with female means and the base with male means.

It may be advantageous to use as male translation means one or more guide rails parallel to translation direction T, and positioned not on the sides of the case but on the bottom of said base 31 or said tray 42 so as to limit the risks of seizing, a corresponding notch forming the female translation means.

It may be advantageous, as shown in FIG. 5, for the clipping means also to form the translation means.

Evidently, numerous variants of embodiment exist which form equivalent means enabling the translation function of the tray relative to the base.

The case of the invention may comprise means to bring said clasp back to its initial position, that is to say to exert a return pressure in an opposite direction to that of the said manual pressure, said initial position being the one in which no manual pressure is applied to said clasp, the said case being open.

Typically, as shown in FIG. 2, said means to return said clasp to its initial position is based on the co-operation between an elastic return tab 44 and blocking means 33 for its free edge 440, said elastic tab 44 being carried by said tray 4 and said blocking means 33 being carried by said base 3. A reverse system is possible to achieve the same function, said elastic tab being carried by said base, and said blocking means being carried by said tray.

This elastic tab ensures return of the tray to its initial position and immobilises the latter when the user withdraws some of the make-up product content.

As also shown in FIG. 2, said clasp 7 may comprise a front stop part 72 which comes to rest against edge 34 of said base 3 when no manual pressure is exerted against said clasp.

It may be advantageous, as shown in FIG. 5, and in particular to control or limit to a desired degree the free play of said tray 4 relative to said base 3, for said tray or said base to comprise flexible friction tabs 45 which tend to separate the bottoms of said base 31 and said tray 42 thereby reducing free play between tray 4 relative to base 3 both in the vertical direction and in the horizontal T direction.

Indeed it would be unacceptable firstly for a case to comprise a part with substantial free play which could emit a slight sound at any time, and secondly these flexible tabs must not prevent the transfer of pressure Fo to the lid.

According to a first embodiment of the invention, illustrated in FIGS. 1, 3, 7*a* to 7*c,* 9*a* to 9*c,* said means for transferring to said lid 2 the manual pressure exerted on said clasp 7 at each opening of the said case, which pressure firstly enables unlocking of said lid 2, is rigid and may be moved in said direction T over a distance at least equivalent to D1 which is the distance over which said locking catch 21 and said lip 81 co-operate together.

According to a second embodiment of the invention, illustrated in FIGS. 8*a* to 8*c,* 9*b* and 9*d,* said means for transferring to said lid 2 the manual pressure applied to said clasp 7 at each opening of the said case, comes to press against said part 22 of said lid and is provided with a certain degree of elasticity allowing unlocking of the said lid while transferring to said lid at least part of said manual pressure such as to ensure said pre-opening.

In this case, the tray firstly has some flexibility so that unlocking of the clasp may take place, and secondly a certain amount of rigidity so that part of the opening pressure Fo may be transmitted to the lid, in particular via the means provided to ensure translation of the tray or optionally via the free play of tray 4 in said base 3.

Figure 9A:
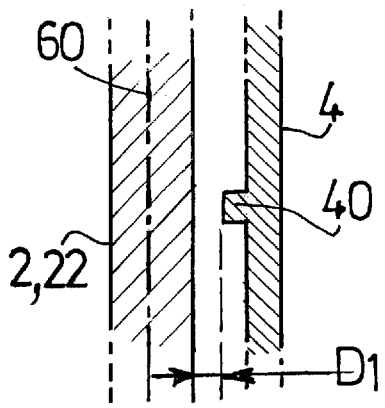
* and FIGS. 9*a*–9*d* illustrate further embodiments of the invention. They are partial diagrams along the horizontal plane parallel to axis 60 of hinge 6.
Figure 9B:
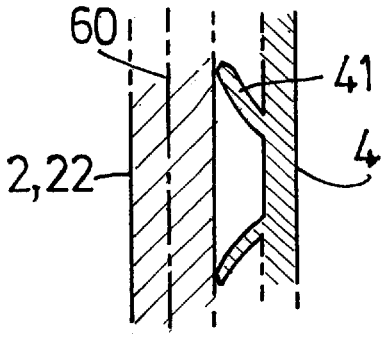
Figure 9C:
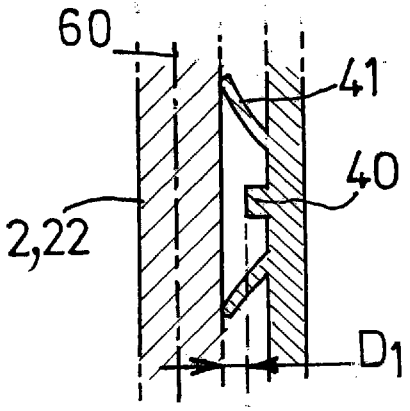
Figure 9D:
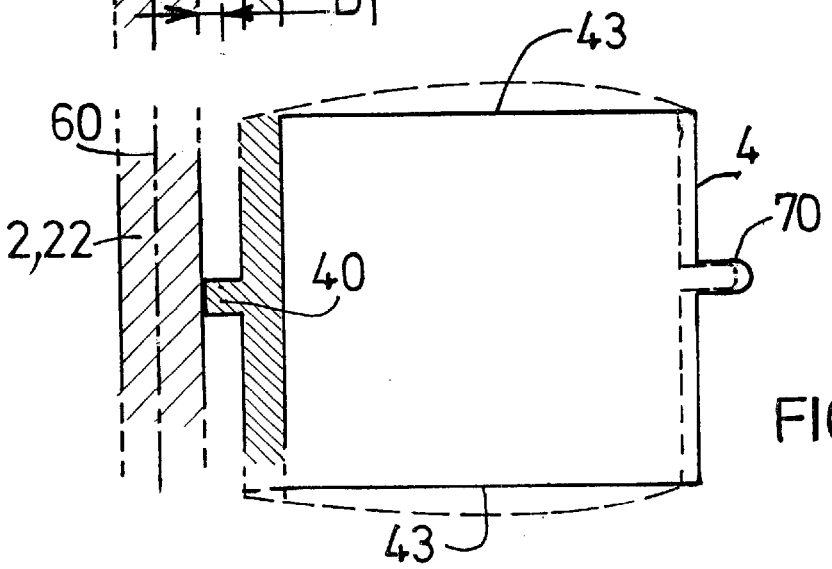

Typically, the tray may be designed so as to allow slight bending of its sides during movement D1 of the clasp ensuring unlocking of the lid, as illustrated in FIGS. 8*b* and 9*d* in which the bent edges of the tray are shown in a dotted line, so that, once unlocking has been achieved, the energy of the flexion stored in the tray is transmitted to the lid and serves to obtain said pre-opening.

It is important to note that the pre-opening or full opening of the case may be obtained by the manual pressure exerted on pushbutton 70, and also optionally by the permanent spring effect of strips 41 carried by tray 4 (see FIGS. 9*b* and 9*c*), an additional means to the manual pressure giving it more magnitude. In broad outline, these strips are under permanent tension, the case being closed, then, since unlocking of the pushbutton compresses strips 41, the tension of the strips increases and reaches its maximum at time $t=t_A$, then decreases with the opening of the lid, and finally returns to its permanent tension value when the lid is closed.

With the invention it is possible to limit the permanent spring effect of strips 41 to a level that is sufficiently low so that over time there is no deformation of the case or gradual reduction in this spring effect.

EXAMPLES OF EMBODIMENT

Cases were produced with trays in polyacetal in accordance with the figures and according to the two main embodiments of the invention, whose functioning is illustrated in FIGS. 7*a* to 7*c* for the first embodiment and in FIGS. 8*a* to 8*c* for the second embodiment.

These two embodiments vary:

- in the thickness of the sides of tray 4 which is approximately 20% less thick in the second embodiment to obtain the desired flexibility,
- in the abutting stop 40,41 which is not in direct contact in the first embodiment shown in FIG. 9*a,* whereas there is direct contact in the second embodiment shown in FIG. 9*d,* but cases were also produced which correspond to FIGS. 9*b* and 9*c* in which there is a permanent spring effect via strips 41 which tend to exert a permanent pressure on supporting edge 22 of the lid facilitating said pre-opening or substantially increasing its magnitude.

In all cases, the cases comprise the generic elements shown in FIGS. 1 to 5.

The functioning of each embodiment of the invention is explained in FIGS. 7*a* to 7*c* for the first embodiment and in 8*a* to 8*c* for the second embodiment. In these diagrams the tray 4 is shown symbolically by a horizontal line ending on one side (on the right) in a pushbutton 70, and on the other side (on the left) in an abutting stop 40.

FIGS. 7*a* and 8*a* relate to time t=0 in which manual pressure has not yet started to be applied on pushbutton 70.

FIGS. 7*b* and 8*b* relate to time $t=t_A$ in which manual pressure has enabled pushbutton 70 to be moved over a distance D1 corresponding to the distance over which catch 21 covers lip 71, which is typically in the region of 1 to 2 mm, so that since the lip and catch are drawn apart in direction T over said distance D1, the clasp of the case is unlocked. FIGS. 7*c* and 8*c* correspond to time $t=t_B$ in which the manual pressure was continued over a total distance D2>D1, which pressure serves to ensure said pre-opening.

As can be seen in these figures, the essential differences between the two embodiments of the invention lie in the fact that, in the first embodiment, the abutting stop 40 only comes to press against supporting edge 22 of the lid after the clasp has been unlocked, the tray having moved, translated towards the left over a distance at least equal to D1, whereas in the second embodiment, the abutting stop 40 is permanently rested or virtually rested against supporting edge 22 of the lid, which implies some flexion of the tray walls so that the assembly made up of the clasp, tray and its abutting stop may have its length reversibly reduced in direction T over a distance D1 without causing detriment to the intactness of the case or to its proper functioning in accordance with the invention.

With these cases of the invention, it is possible to obtain pre-opening or opening which may, according to the precise configuration, range from 20° to 90° in respect of the angle of opening, which typically relates to a distance in the order of 30 to 60 mm between the edges of the lid and the base (see FIG. 4) in cases of normal standard size.

ADVANTAGES OF THE INVENTION

The invention discloses a new concept for a case with pre-opening which combines simplicity of manufacture, the number of parts in a case of the invention not being increased, with large adaptability to client needs, insofar as the invention discloses a variety of means to obtain any type of desired pre-opening, and even if need be, a pre-opening value close to 90°, which value approximates a standard opening value.

It is important to note that for the most part these means of the invention are scarcely visible, even hidden from the user, insofar as the tray may have a rim which masks the abutting stop 40 and most of the hinge as seen from inside the case.

In addition, the invention may be applied to and potentially adapted to most existing cases. However, in respect of round-shaped cases, the means of the invention need to be adapted so as to obtain transfer of the manual pressure towards the lid.

Finally, the invention achieves pre-opening, even full opening of the case, optionally via a combination of means including a spring effect, typically that obtained by flexible strips 41, so that by adapting this combination of means it is possible to obtain a large variety of cases having an adjustable degree of opening or pre-opening, possibly requiring manual pressure to unlock the lid which is also adjustable so that cases can be better adapted to meet specific demands.

LIST OF REFERENCE NUMBERS

CASE . . . 1
LID . . . 2
FIRST HINGE PORTION . . . 20
LOCKING CATCH . . . 21
SUPPORTING EDGE . . . 22
BASE . . . 3
SECOND HINGE PORTION . . . 30
BOTTOM PART . . . 31
SIDES . . . 32
  FEMALE ELEMENT . . . 320
BLOCKING MEANS . . . 33
RIM . . . 34
TRAY . . . 4
ABUTTING STOP=STUD . . . 40
STOP=STRIP WITH SPRING EFFECT . . . 41
  BOTTOM PART . . . 42
  SIDES . . . 43
  MALE ELEMENT . . . 430
ELASTIC RETURN TAB . . . 44
  FREE END . . . 440
FRICTION TABS . . . 45
DISH . . . 5
HINGE (=20+30) . . . 6
AXIS . . . 60
CLASP . . . 7
PUSHBUTTON . . . 70
LIP . . . 71

FRONT STOP PART . . . 72
RUNNER (=320+430) . . . 8

What is claimed is:

1. A cosmetic case comprising:

a lid with a first hinge portion formed therein;

a hollow base having a second hinge portion therein and rotationally secured to the first portion, the hinge portions located at a rear end of the case a tray translationally mounted within the base;

a dish, for holding a cosmetic product, located in the tray;

engageable clasp members respectively mounted to the lid and the tray for releasably securing the lid and base together;

a push button located at a front end of the case and mounted to the tray for displacing the tray rearwardly within the base upon actuation of the push button in a rearward direction for releasing the engaged clasp members;

horizontally extending means mounted to a rear end of the tray and adjacent the hinge portions for horizontally transferring rearwardly exerted force from the push button, to an internal surface of the lid, opposite the force transferring means, thereby pushing the lid sufficiently open to hingedly separate the lid and base thereby exposing the cosmetic product.

2. The case set forth in claim 1 wherein the push button and a clasp member are integrally formed with the tray; and further wherein the force transferring means is an abutment stop.

3. The case set forth in claim 1 together with slidably engaged runner members formed in the base and tray for translationally mounting the tray in the base.

4. The case set forth in claim 1 together with means mounted to the base and tray for biasing the clasp members in a normally secure relation.

5. The case set forth in claim 1 together with a projecting stop member located on a front end of the tray for contacting an opposing internal surface of the base to limit forward displacement of the tray.

6. The case set forth in claim 1 together with flexible elastic members located between the base and tray for limiting free play of the tray in the horizontal and vertical directions.

7. The case set forth in claim 1 wherein the tray and force transferring means mounted thereto are displaced by a sufficient distance during actuation of the push button to clear engagement of the clasp members and permit separation of the lid from the base.

8. The case set forth in claim 1 wherein the force transferring means is an elastic member for permitting unlocking of the lid while transferring at least part of the force to ensure separation of the lid from the base.

9. The case set forth in claim 2 wherein the abutment stop is a stud formation.

10. The case set forth in claim 2 wherein the abutment stop is an elastic flexible strip.

* * * * *